US008511134B2

(12) United States Patent
Brennand et al.

(10) Patent No.: US 8,511,134 B2
(45) Date of Patent: Aug. 20, 2013

(54) DIE FORMER

(75) Inventors: Philip Brennand, Barnoldswick (GB); Dion Soraine, Shipley (GB)

(73) Assignee: Rolls-Royce PLC, London (GB)

( * ) Notice: Subject to any disclaimer, the term of this patent is extended or adjusted under 35 U.S.C. 154(b) by 204 days.

(21) Appl. No.: 12/861,557

(22) Filed: Aug. 23, 2010

(65) Prior Publication Data

US 2011/0061438 A1 Mar. 17, 2011

(30) Foreign Application Priority Data

Sep. 11, 2009 (GB) ..... 0915949.2

(51) Int. Cl.
*B21D 22/02* (2006.01)
*B21D 13/02* (2006.01)

(52) U.S. Cl.
USPC ..... 72/414; 72/57; 72/347; 72/348; 72/350; 72/360

(58) Field of Classification Search
USPC ..... 72/347, 348, 350, 360, 414, 57
See application file for complete search history.

(56) References Cited

U.S. PATENT DOCUMENTS

| | | | | |
|---|---|---|---|---|
| 2,791,138 | A * | 5/1957 | Albers | 72/456 |
| 2,958,362 | A * | 11/1960 | Creek | 72/412 |
| 4,252,011 | A * | 2/1981 | MacNitt et al. | 72/354.2 |
| 4,941,344 | A * | 7/1990 | Beech et al. | 72/456 |
| 7,100,259 | B2 * | 9/2006 | Morales et al. | 29/421.1 |
| 7,340,934 | B2 * | 3/2008 | Kurokawa et al. | 72/350 |
| 2005/0172694 | A1 * | 8/2005 | Hewitt | 72/414 |
| 2005/0247101 | A1 | 11/2005 | Lorieux et al. | |
| 2006/0243017 | A1 | 11/2006 | Jung et al. | |

FOREIGN PATENT DOCUMENTS

| | | |
|---|---|---|
| EP | 0 328 476 | 8/1989 |
| GB | 1 461 317 | 1/1977 |
| GB | 2 073 631 A | 10/1981 |
| GB | 2 140 339 A | 11/1984 |
| JP | A-6-328183 | 11/1994 |
| JP | A-6-328184 | 11/1994 |
| JP | A-2001-129622 | 5/2001 |

OTHER PUBLICATIONS

British Search Report issued in British Application No. 0915949.2 on Dec. 22, 2009.

* cited by examiner

*Primary Examiner* — Dana Ross
*Assistant Examiner* — Onekki Jolly
(74) *Attorney, Agent, or Firm* — Oliff & Berridge, PLC

(57) ABSTRACT

Forming processes such as hot creep forming or superplastic deformation require a die former. This die former includes a lower die and an upper die within which an initial roughly shaped component is placed and then shaped by downward pressure between the die parts. Previous arrangements have included a simple stop to engage edges of the component to define position. In use, due to the nature of the forming process, movement of the component can occur, and in such circumstances it may be necessary for the operator to adjust the position of the component during the forming process. By utilising pegs about the periphery at least of leading and trailing edges of a component, a better edge definition is created, thereby reducing the requirement for interim positioning of the component in use.

15 Claims, 5 Drawing Sheets

DIE FORMER

The present invention relates to a die former and more particularly to a die former utilised in hot creep forming or superplastic forming.

BACKGROUND

A number of components, such as blades utilised in gas turbine engines, are initially formed in a rough or preformed state and then subsequently processed through additional forming processes such as hot creep forming or superplastic deformation to nearer a final shape as required. FIGS. 1 to 6 of the attached drawings illustrate a typical prior art forming process in which a die former 100 is utilised. The die former 100 comprises a lower die 1 and an upper die combination formed by die parts 2, 3. As illustrated in FIG. 1 a component in the form of a twisted blade preform 4 is placed within the die former 100 between the lower die 1 and upper die 2, 3. Generally, the lower die 1 is static while the upper die 2, 3 is forced under an appropriate load pressure vertically downward towards the lower die 1 such that the mould parts 101, which are typically recesses in the die parts 1, 2, 3 (only shown in lower die 1), are associated to further form the component 4. As will be described later the component 4 and therefore the die parts 1, 2 and 3 are at elevated temperatures in order to provide the hot forming process as required. The forming process may include inducing a twist in a component by the opposed shape of the die parts 1, 2, 3 as they are forced together.

In terms of the method of operation the component 4 is placed in the lower die 1 and typically such that a root part 102 of the component 4 is in position so that an end face 21 engages a stop 11 (which may be referred to as a reciprocal face 11) in a root stop 103 of the die former 100. Furthermore, a trailing edge face 20 of the component 4 engages a stop 10 (which may be referred to as a reciprocal edge face 10) within the die former 100 about a periphery 50 of the mould portion 101.

In the embodiment illustrated the die parts 2, 3 are respectively brought down forcefully and vertically towards the lower die 1. In such circumstances initially the root portion 102 of the component 4 will be held and formed. This will be achieved through the die part 3, as indicated, being forcefully moved down to engage the root part 102 to allow shaping and forming under heat and pressure. The force applied by the die part 3 will cause forming of the root part 102 into its desired, fully formed, final state. FIG. 3 indicates the position of the die part 3 during the forming process while FIG. 4 illustrates the component in position with the die part 3 for root formation removed for clarity.

Once located and secured through the die part 3 and the root portion 102 of the component 4, a further upper die part 2 is brought down forcefully and vertically until a tip or blade portion of the component 4 is fully formed. Thus, as illustrated in FIG. 5 the second die part 2 is adjacent to the first die part 3 and as indicated within the mould parts of the die former 100, shaping and forming of the component 4 achieved. FIG. 6 illustrates the component in its fully completed and formed state presented upon the lower die part 1, with other die parts 2, 3 removed for clarity.

It will be appreciated that the objective of a forming process is to fully form a component, such as a turbine blade, from a rough formed shape into the desired shape typically at high temperature, generally 600° C. to 700° C. The process, as indicated, is typically two stage with an initial first die part 3 brought down followed by a second die part 2. The initial rough formed shape will clearly not be in its final form, and may not fit accurately into the die former, either the lower die 1 or the mould parts of the die former; particularly if a twist is to be formed or extended in the component. In such circumstances upon loading the component 4, an operator is required to adjust, typically using long rigid bars, the position of the component 4 in the mould parts to ensure that the component remains against the stops 10, 11 in the mould parts. Unfortunately, as the die part 3 is typically brought down the initial misshaping of the component dislodges the component from its initial position. Therefore, when the die part 3 is fully closed, a tip of a blade (as an example of a component) may be in a poor position relative to the stops 10, 11. When the die part 2 is fully closed, parts of the component 4 can be positioned such that the die parts 2, 3 must be re-opened and the component repositioned before the dies 2, 3 are re-closed again for forming, in an attempt to improve blade tip position and the overall forming process itself. Such inaccuracies create processing problems as well as potential difficulties with final formed component shape accuracy.

SUMMARY

In accordance with the invention there is provided a die former and a method of forming a component.

BRIEF DESCRIPTION OF DRAWINGS

An embodiment of the invention will now be described, by way of example, with reference to the accompanying drawings in which.

EMBODIMENTS

As illustrated above, it is the positioning of the component in its rough state prior to forming in a die former (typically at elevated temperatures) which is important in order to achieve accurate final shaping of the component. In accordance with the present invention, about a mould former, which typically comprises opposed mould portions in die parts, pegs or blocks are provided which interlock with each other in order to appropriately force positioning for the component during the forming processes. The further forming processes may extend a twist along an axis of the component.

Figure 1:
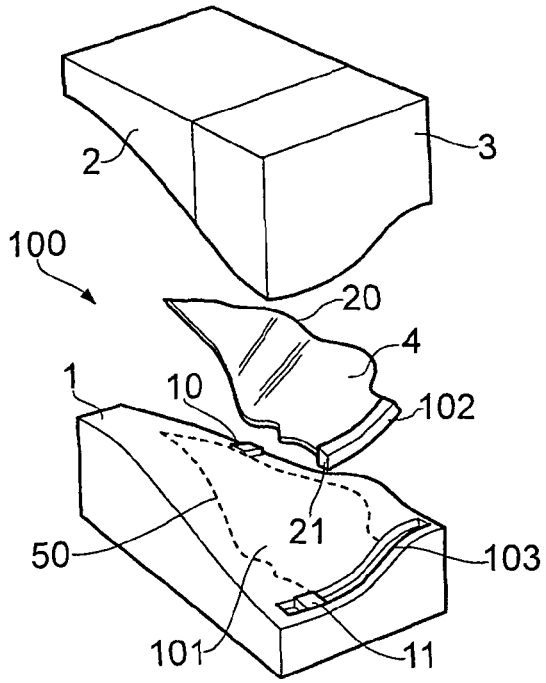
FIG. 1 PRIOR ART
FIGS. 1 and 2 illustrate a typical forming process utilising a die former.
Figure 2:
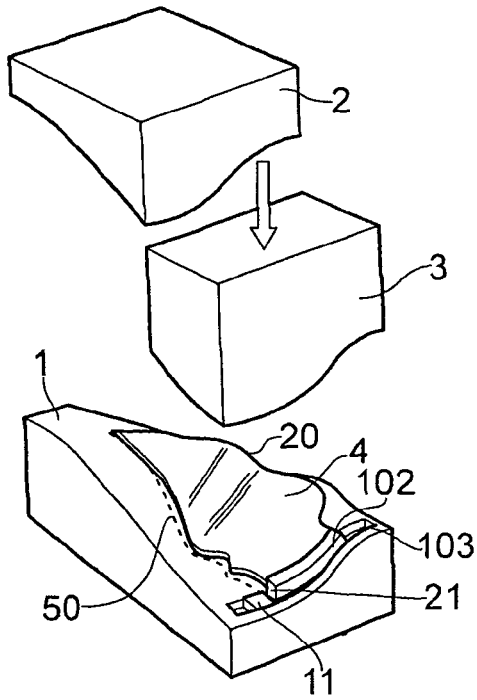
FIG. 2 PRIOR ART
Figure 3:
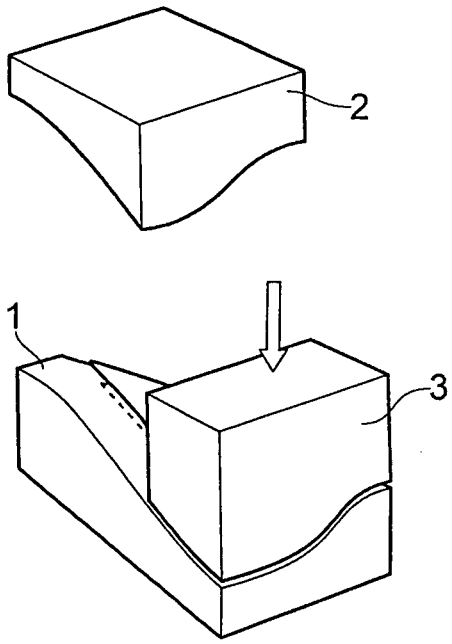
FIG. 3 PRIOR ART
FIG. 3 illustrates a position of a die part during a typical forming process.
Figure 4:
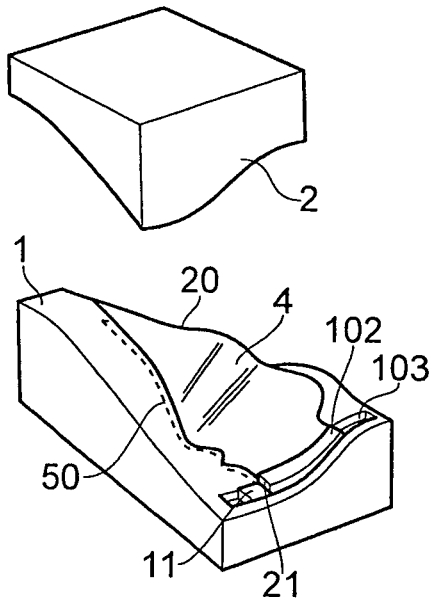
FIG. 4 PRIOR ART
FIG. 4 illustrates a component position with the die part in a typical forming process.
Figure 5:
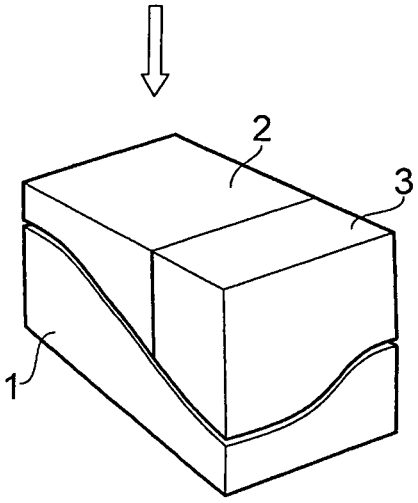
FIG. 5 PRIOR ART
FIG. 5 illustrates a second die part adjacent to a first die part in a typical forming process.
Figure 6:
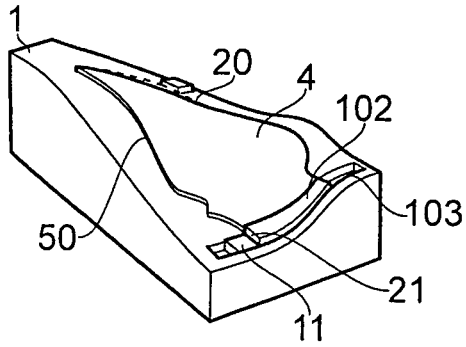
FIG. 6 PRIOR ART
FIG. 6 illustrates a component in its fully completed and formed state.
Figure 7:
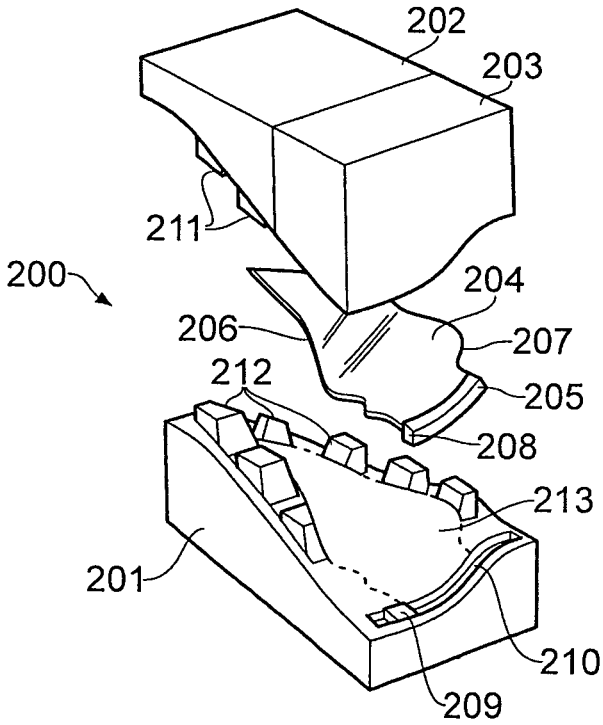
FIG. 7 is an exploded perspective view of a die former.

FIG. 7 provides an exploded perspective view of a die former 200 in accordance with the present invention. The die former 200 comprises a lower die 201 and an upper die formed by die parts 202, 203. The die former 200 is arranged to form a component 204 from an initial state to a final, or nearly final, shape. The component 204 includes a root portion 205 as well as leading and trailing edges 206, 207. The root portion 205, as previously explained, includes an end face 208 which engages a stop 209 in a root recess 210. In such circumstances, the root portion 205 enters the root recess 210 to locate that part of the component 204.

In accordance with the present invention, pegs 211, 212 are provided respectively in the lower die 201 and in the upper die or at least die part 202 of the upper die. The pegs 211, 212 are in the form of teeth which have a gap between them such that the pegs in the opposed mould portions alternate and fill the gap. In such circumstances, the pegs 211, 212 in opposed lower and upper die parts engage at least a part of the edges 206, 207 of the component 204. The pegs 211, 212 are located about a periphery of mould portion 213 to constrain and locate the component 204, particularly during the forming processes. By alternating the pegs 211, 212, a more consistent barrier or stop is created with the edges 206, 207 of the component 204, in order to ensure location of the component 204 in use without the necessity of opening the dies 201, 203 during the process of forming for repositioning.

In FIG. 7 the dies 201, 202, 203 are open to enable the component 204 to be loaded into the lower die 201 for forming processes as required.

Figure 8:
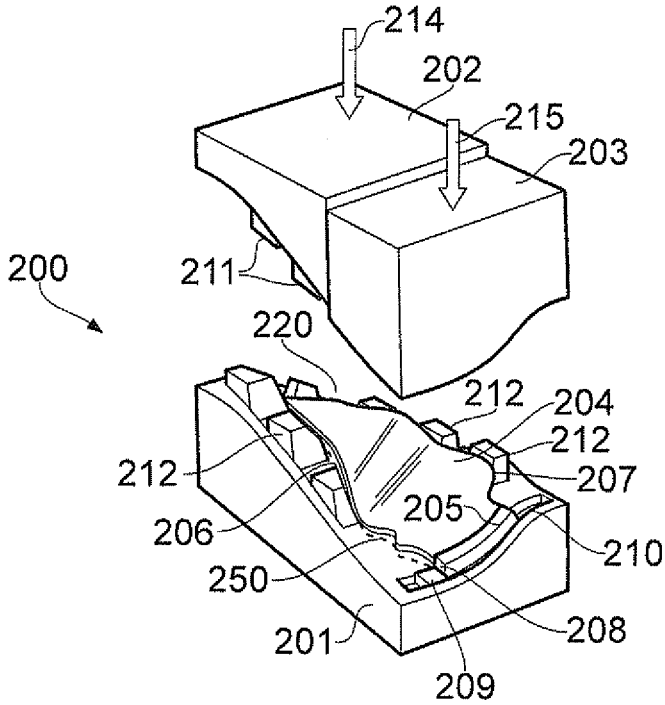
FIG. 8 is a schematic illustration of the die former illustrated in FIG. 7 during initial stages of forming.

FIG. 8 illustrates an initial step of the forming process. In this step the upper die or die parts 202, 203 are forcefully moved in the direction of arrowheads 214, 215, as described above with regard to die parts 2, 3 in FIGS. 1 to 6. In such circumstances, die part 203 engages the root portion 205 to locate the component 204, while the die part 202 engages the tip part of the component 204 to provide the hot forming processes as described above. It will be appreciated that the die former 200, as well as the component 204, will be at elevated temperature, typically in the range of 600° C. to 700° C. for hot creep forming of blades utilised in gas turbine engines.

Figure 9:
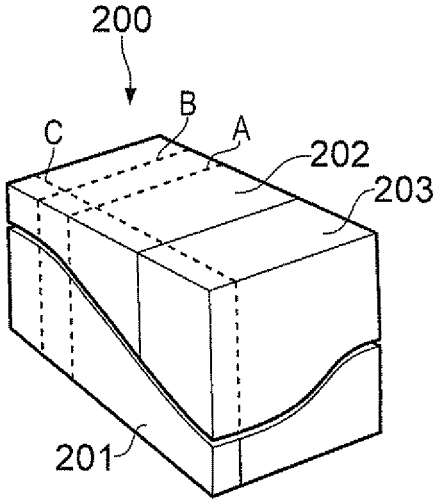
FIG. 9 illustrates the die former as illustrated in FIG. 7 and FIG. 8 with the die parts in mould positions.

FIG. 9 illustrates the lower die 201 and upper die formed by parts 202, 203 in a closed position, whereby hot forming and in particular hot creep forming occurs within a former mould created by respective mould portions in recesses in the dies 201, 202, 203. In FIG. 9, cross-sectional planes A, B and C are illustrated by broken lines and these cross-sections A, B and C are illustrated below respectively by FIGS. 11, 12 and 13.

Figure 10:
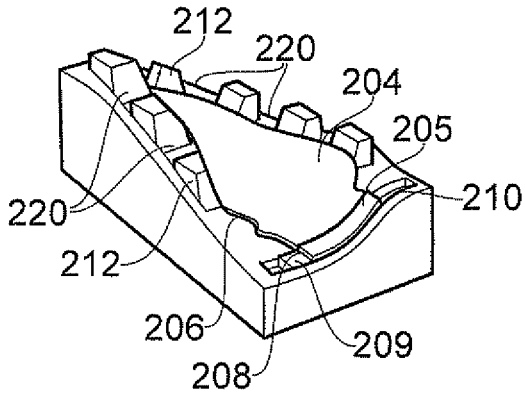
FIG. 10 illustrates a component in the lower die in accordance with aspects of the present invention.

FIG. 10 illustrates the component 204 in its final moulded state within the lower die 201. As can be seen the edges 206, 207 of the component 204 are generally constrained and stopped by the pegs 212. It will be understood that in the mould position gaps 220 between the pegs 212 are filled by pegs (not shown) from the opposed upper die, namely pegs 211 about the opposed mould portion in that upper die and in particular upper die portion 202. By the constraint created by the pegs 212 and pegs 211 (not shown) it will be understood that more accurate positioning and retention of position of the component 204 is achieved throughout the forming process.

Figure 11:
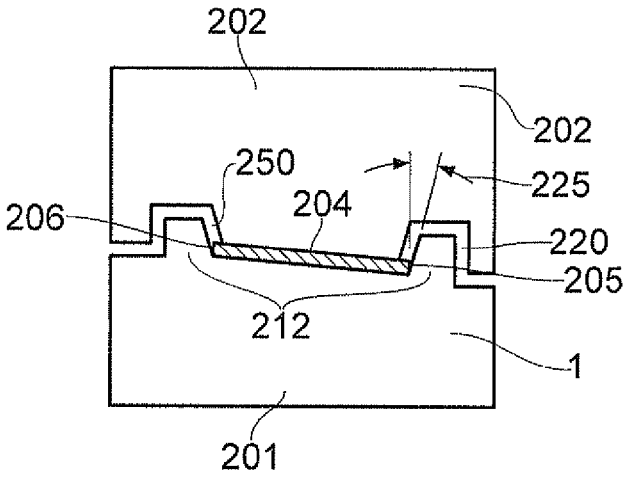
FIG. 11 is a cross-section of the die former as illustrated in FIG. 9 in the sectional plane A.
Figure 12:
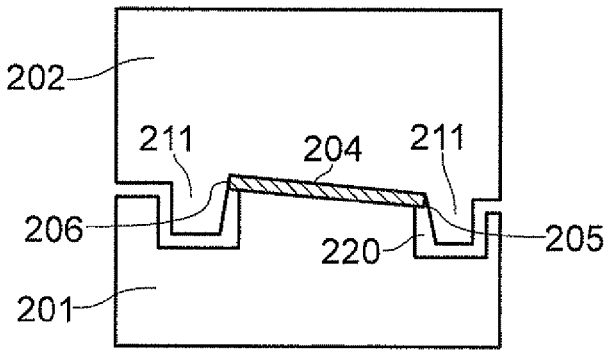
FIG. 12 is a cross-section of the die former as illustrated in FIG. 9 in the plane B; and, FIG. 13 is a schematic illustration of a cross-section of the die mould as illustrated in FIG. 9 in the sectional plane C.
Figure 13:
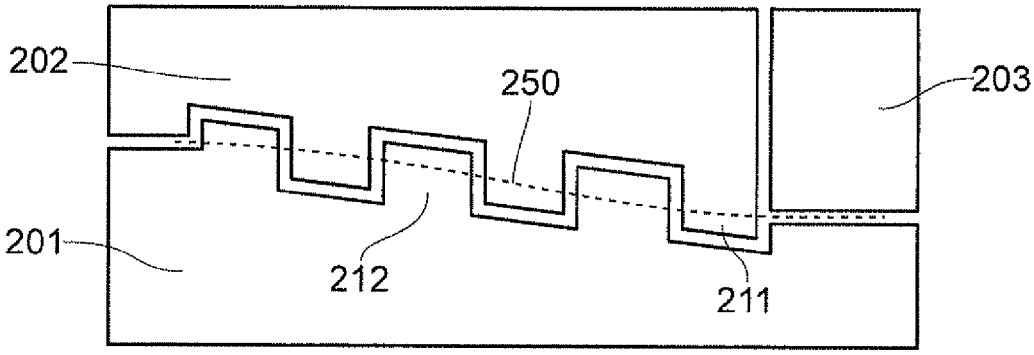

FIGS. 11 to 13 illustrate cross sections A, B, C as depicted in FIG. 9. The pegs 211, 212 act as teeth which encompass the component 204 around the leading edge 206 and trailing edge 207 in the former mould defined between the die parts 201, 202, 203. However, as indicated above the initial component 204 is in a relatively rough state and therefore may be spaced from the periphery of the former mould created between the die parts 201, 202, 203. Similarly, the pegs or teeth will be along that former mould periphery, and therefore spaced from the component 204 as initially presented; but the component 204, under the forming pressure and temperature which create creep or other forming processes, will move towards the edge created by the pegs 211, 212 acting as a periphery around the former mould. Thus, the component 204 will move to be formed during the forming process towards the peripheral edge created by the interlocking pegs 211, 212.

FIGS. 11 to 13 show the component 204 in its final formed state towards the end of the forming process. As can be seen, the component (in the form of a blade) generally has a twist through an angle 225 to the perpendicular. The component has moved to the edges of the former mould created by opposed mould portions in the dies 201, 202. It will be noted that the gap between the pegs 211, 212 depicted in FIGS. 11 to 13 is much greater than in reality for clarity of definition between the die parts 201, 202, 203. In reality, the periphery created by the pegs 211, 212 will be more finely defined and therefore more appropriate for blade edge formation. The angle 225 which defines the twist in the component 204 may be in the range of up to 30 degrees.

FIG. 11 and FIG. 12 show cross-sections A, B. It will be seen that the alternation between the pegs 211, 212 is provided while the component 204 in the twisted state is formed in the former mould created between the respective die parts 201, 202. The alternating pegs 211, 212 define an accurate periphery 250 for the former mould and therefore create an edge barrier or stop for the forming process.

FIG. 13 illustrates cross-section C as depicted in the die former 200 shown in FIG. 9. As can be seen, the periphery 250 is shown by a broken line and extends from one end of the die former 201 to the other in a curve or slope. This curve or slope is again replicated by the interlocking and engaged pegs 211, 212 to define the periphery 250 within which a component 204 is formed.

It will be appreciated that alignment between the lower die 201 and the upper die in the form of die parts 202, 203 is important. As depicted in FIG. 13, generally the die part 203 is utilised in that part of the die former associated with the root portion of the component 204. In such circumstances, the keying and alignment created by the root portion and stops within the root recess can be utilised to ensure appropriate alignment between the die part 203 and the lower die 201. With regard to the tip or blade sections of the component formed in the die former 200 between the lower die 201 and the upper die part 202, accurate alignment is required in order to create an accurate periphery for the leading and trailing edges of the component. Such alignment may be achieved through configuring the pegs 211, 212 to have angled or otherwise shaped surfaces which urge towards the desired peripheral edge in the closed former mould state between the lower die 201 and the upper die part 202. In such circumstances, in the final closed position, correct alignment will be achieved to define the leading and trailing edges as well as the component 204 itself, between the die parts 201, 202, 203.

It will be understood that the upper die 202 generally is movable, while the lower die 201 is static. The die parts 202, 203 may move down together and may be combined into a unitary die former if required. Alternatively, as is conventional, the die parts 202, 203 may move down separately in sequential order. Furthermore, one of the die parts 202, 203 may move down partially and the other die part 203, 202 then fully engage the component 204, before the first die part 202, 203 again moves into a fully closed position. By such sequencing, positioning of the component from the rough initial shape to the final formed shape may be more accurately achieved. It will be understood that the forming processes utilised with a die former in accordance with the present invention may include hot creep or superplastic forming, and in such circumstances sequencing of movement of the die parts towards the final closed shape may be required for most efficient forming of the final shape.

By the application of the present invention, movement of the component (particularly in the form of a blade) is restricted during the forming processes resulting in a better final position, defined and confined by the periphery defined by the interlocking pegs. Such better control of the position eliminates the need for an operator to continually reposition the component during the forming processes and therefore reduces complexity and potential error in the processes. The pegs, as indicated, take the form of teeth, and so through their interlocking nature, as indicated, will restrict radial movement as well as lateral movement between the lower die and the upper die, again creating better consistency in the former mould in the forming processes.

The number of pegs and the space between the pegs will depend upon operational requirements. Typically a small number of pegs is used, in order to reduce complexity within the die parts and to provide smooth sections for the periphery with limited interengagement gaps. Furthermore, there will be small dimension gaps, in use, between adjacent pegs from the alternating upper and lower die parts. The pegs will be shaped and configured for appropriate interlocking to define the periphery within the former mould created between the die parts. In such circumstances the pegs will have a height sufficient to create such interengagement and provide robust stop barriers at the periphery to the former mould to create the leading and trailing edges as defined above in the component. Greater depth of interengagement will help with alignment and with the strength of the stop barrier created.

The pegs may take a number of cross-sectional profiles. These profiles, for example, may be circular, rectangular, rhomboidal, oblong or obround. Furthermore, the profiles may be in a single plane, two planes/dimensions or fully three-dimensional, either singularly or in combination, to define (through their interengagement) the peripheral stop for the former mould in the die former. The pressure and temperature within the die former creates forming through a hot creep process, and containment of the "flow" of the component during that process is effected by the interengagement at the peripheral edge of the former mould. The material of the component will generally not be sufficiently flaccid that a fluid tight peripheral edge must be created by the interengagement between the pegs. Nevertheless, the gaps between the pegs should be sufficiently small that no unacceptable roughening of the edge is created in use.

As indicated above, dies can be formed in a single piece, in accordance with the present invention, due to the alignment effects of the pegs interengaging with each other. Dies can be utilised for hot creep forming as well as superplastic forming.

Generally, a die former in accordance with the present invention will be specifically shaped for each particular application. In such circumstances, the pegs in each die part or opposed mould portion may be of different sizes and shapes, but reciprocation between opposed pegs, in terms of spaces and gaps between the pegs, in order to define the peripheral edge must be considered. The pegs may be of different depths as required.

It will be understood that it is the corner angle between the peg and mould parts of the die which defines the shape of the edge periphery to the former mould in accordance with aspects of the present invention. In such circumstances this corner edge may be chamfered, radiused or angled in order to create the edge shape as required. Modifications and alterations to the present invention will be appreciated by persons skilled in the technology. In particular, the pegs to create the periphery edge to the former mould in the die parts may be formed from the same material as the die parts and integrally formed with those die parts; or, alternatively, may be inset and secured as required in use. Thus, the pegs may be formed of a different material from the mould itself. It will also be understood that a seaming edge or holder may be created and supported upon the pegs to act as a peripheral edge seal for a component and so help define the final shape of the component in use. In such circumstances the pegs may support that edge feature within the mould.

The invention claimed is:

1. A die former comprising a lower die and an upper die relatively displaceable towards each other to define a former mould therebetween from opposed mould portions, each mould portion having a periphery for the former mould and the periphery having peg elements spaced along the periphery with gaps between them, the gaps being arranged to receive peg elements from the opposed mould portion such that the peg elements of each mould portion fit into the gaps of the opposed mould portion so as to be interlocking, the interlocking peg elements defining at least part of the periphery in use.

2. The die former as claimed in claim 1 wherein the peg elements are about opposed parts of the periphery.

3. The die former as claimed in claim 1 wherein the peg elements extend about an end of the former mould.

4. The die former as claimed in claim 1 wherein the gaps are substantially closed by received peg elements from the opposed mould portion.

5. The die former as claimed in claim 1 wherein the pegs are shaped and configured to inhibit lateral relative displacement and/or rotational movement between the mould portions.

6. The die former as claimed in claim 1 wherein the pegs have an angled surface to urge alignment therebetween and so between the opposed mould portions.

7. The die former as claimed in claim 1 wherein the upper die comprises more than one die part.

8. The die former as claimed in claim 7 wherein the pegs are provided in only one die part of the upper die.

9. The die former as claimed in claim 1 wherein the former mould is for a gas turbine blade with a leading edge and a trailing edge.

10. The die former as claimed in claim 9 wherein the pegs are only about the periphery of the former mould associated with the leading edge and/or the trailing edge.

11. The die former as claimed in claim 1 wherein the former die is configured for hot creep forming or superplastic forming.

12. The die former as claimed in claim 1 wherein the mould portions are arranged to define a twist along an axis of the component.

13. A method of forming a component comprising utilising a die former as claimed in claim 1 and forcefully bringing together the lower die and the upper die to form a component within the die former.

14. A method as claimed in claim 13 wherein the pegs are provided to progressively contain a component within the former mould during the method.

15. A method as claimed in claim 13 wherein the forming process is hot creep forming or superplastic deformation.

* * * * *